United States Patent [19]

Long et al.

[11] Patent Number: 5,024,186

[45] Date of Patent: Jun. 18, 1991

[54] REMOTE AUTOMOBILE STARTER

[75] Inventors: Robert Long, New Carrolton, Md.; Mark Gottlieb, Annandale, Va.

[73] Assignee: Design Tech International, Inc., Springfield, Va.

[21] Appl. No.: 448,289

[22] Filed: Dec. 11, 1989

[51] Int. Cl.[5] ..... F02N 11/08

[52] U.S. Cl. ..... 123/179 B; 123/179 K; 180/167; 307/10.6

[58] Field of Search ..... 123/179 B, 179 BG, 179 K, 123/179 R, 179 A; 180/167; 307/10.6; 290/38 C, 38 R

[56] References Cited

U.S. PATENT DOCUMENTS

| | | | |
|---|---|---|---|
| 3,455,403 | 7/1969 | Hawthorne | 123/179 B |
| 3,530,846 | 9/1970 | Bean et al. | 123/179 BG |
| 3,657,720 | 4/1972 | Avdenko et al. | 290/38 C |
| 4,080,537 | 3/1978 | Bucher | 123/179 B |
| 4,227,588 | 10/1980 | Biancardi | 180/167 |
| 4,345,554 | 8/1982 | Hildreth et al. | 123/179 BG |
| 4,674,454 | 6/1987 | Phairr | 123/179 B |

FOREIGN PATENT DOCUMENTS

| | | | |
|---|---|---|---|
| 63-277858 | 11/1988 | Japan | 290/38 R |

*Primary Examiner*—Andrew M. Dolinar

*Attorney, Agent, or Firm*—Oblon, Spivak, McClelland, Maier & Neustadt

[57] ABSTRACT

The present invention pertains to features which are to be incorporated into remote automobile starter units. These features include a diagnostic system to aid in the installation of a remote automobile starter unit. Another aspect is a security feature which ensures that a vehicle is not driven away by an unauthorized driver after it has been remotely started. Another aspect is a feature which prevents a remote automobile starter unit from being functionally placed in automobiles with manual transmissions.

12 Claims, 5 Drawing Sheets

REMOTE AUTOMOBILE STARTER

BACKGROUND OF THE INVENTION

1. Field of the Invention

The present invention concerns remote automobile starters and more specifically remote starters having improved diagnostic, security and safety features.

2. Discussion of the Background

There are currently several remote automobile starter units on the market. Each of these products allows the user to start an automobile by remote control. Several of these remote automobile starter units also offer a number of safety features. For example, some units cut off after the engine runs for 10 minutes or if the hood is opened before the key is put in the ignition.

The remote automobile starters currently on the market, however, suffer from various drawbacks. One such drawback stems from the complexity in installing such units. Remote automobile starters need to be hooked up to a large number of wires in a variety of different locations under the dash and under the hood of the car. The color of each wire is different from car to car—and even from year to year with the same make and model of the car. This complexity means that remote automobile starters require a substantial amount of professional installation time and expertise for correct installation. Generally speaking, the more features a unit has, and the more safety guards it has, the more complicated and expensive the installation project becomes. When an installer puts any unit with the complexity of a remote automobile starter into a car, the chance for error or confusion in the installation is great. Remote automobile starters contain from 8 to 15 wires which must be integrated with the wiring of the car. Additional wiring, extra fuses, tach sensing devices, relays and often a separate remote control radio receiver unit must also be installed. Each car's wiring system and wiring colors are unique, so it is difficult for even the most experienced installers to be sure that the unit is being installed correctly.

Commonly, an installation of a remote automobile starter will take several hours. Also commonly, at the end of this time, the installer will push the "start button" only to find that nothing happens, or maybe that the wrong thing happens. At this point all the wires must be rechecked. This can take considerable time, since the installer usually doesn't know where to start looking for the problem. If the unit still does not function properly after the wiring is rechecked, the installer will not know for sure if one of the unit components is defective or if the installation job is incorrect.

Another problem with remote automobile starters is ensuring that the vehicle is not driven away by an unauthorized driver after it has been remotely started. One way of preventing the vehicle from being driven away once it has been started, is to determine if the vehicle is being taken out of park without the key in the ignition. When this occurs, the unit can be shut down immediately. The remote automobile starters currently on the market utilize the "neutral safety switch" of an automatic transmission to provide this security feature. This "neutral safety switch" is a switch which is connected in series with the starter wire and which functions to physically disconnect the wire behind the key switch area from the starter motor when the car is put into any gear. Thus, this "neutral safety switch" is only closed (to allow current to pass) when the car is in park. Hooking up to this "neutral safety switch" is very time consuming and difficult since the "neutral safety switch" is often not easily accessible.

Another drawback of the remote automobile starters currently on the market is that they cannot prevent their units from being installed in automobiles with manual transmissions. A fear of all manufacturers of remote automobile starters is that a customer will install the unit in a manual transmission car. If the user leaves the car in gear, then the car will lurch forward or backward the next time it is started remotely. No manufacturer has, up to this point, developed a satisfactory method for rendering the remote automobile starter unit inoperable when placed into a manual transmission car.

SUMMARY OF THE INVENTION

Accordingly, the objects of this invention are to provide a novel solution which overcomes the above mentioned drawbacks with current remote automobile starters.

A first object of this invention is to provide a novel self-diagnostic system which informs the installer that the wiring of the remote automobile starter is being attached correctly. This system also functions as a valuable trouble shooting aid in that the installer is informed as to exactly where the problem is if the unit does not function properly after installation.

A second object of this invention is to provide a novel neutral switch sensing feature which serves to reduce installation time. This feature serves the important function of sensing if the car is being put into gear after it is remotely started. For security and safety reasons, this feature will turn off the automobile if it is put into gear, unless the user's key has been put in the ignition and turned to the "run" position. Another benefit of this neutral switch sensing feature of the present invention is that it serves to reduce installation time in that it is no longer necessary to directly hook up into the relatively inaccessible "neutral safety switch" as required for prior art units.

A third object of this invention is to provide a novel manual car self-disablement circuit which causes a remote automobile starter to self-disable itself if it sees that it has been installed in a manual transmission car.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
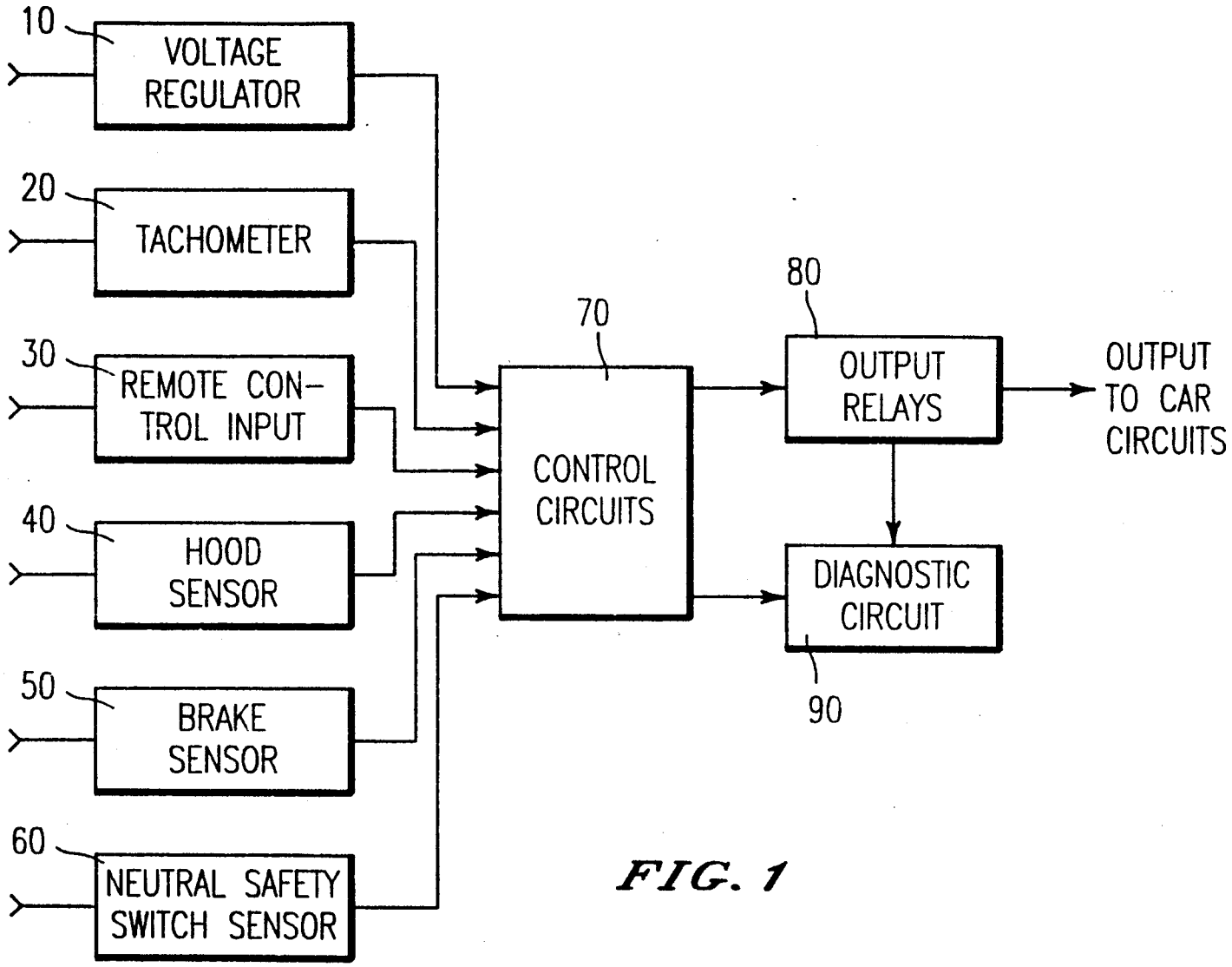
FIG. 1 shows a block diagram of a remote automobile starter incorporating a diagnostic system according to the present invention.

Referring now to the drawings, wherein like reference numerals designate identical or corresponding parts throughout the several views, and more particularly to FIG. 1 thereof, there is shown a block diagram of a remote automobile starter system incorporating a diagnostic circuit. FIG. 1 shows various remote automobile starter elements whose outputs are fed into a control logic circuit 70 of a remote automobile starter unit. These various remote automobile starter elements include a voltage regulator 10, a tachometer 20, a hood sensor 40, a brake sensor 50, and a neutral safety switch sensor 60. Also input into the control circuit 70 of the remote automobile starter unit is a remote control input 30 which receives a signal indicating that the car is to be remotely started. An output from the control circuit 70 is fed to a set of output relays 80 and to the diagnostic circuit 90. The set of output relays 80 is also connected to the diagnostic circuit 90. The output relays 80, then, are connected to the appropriate automobile circuits.

Figure 2:
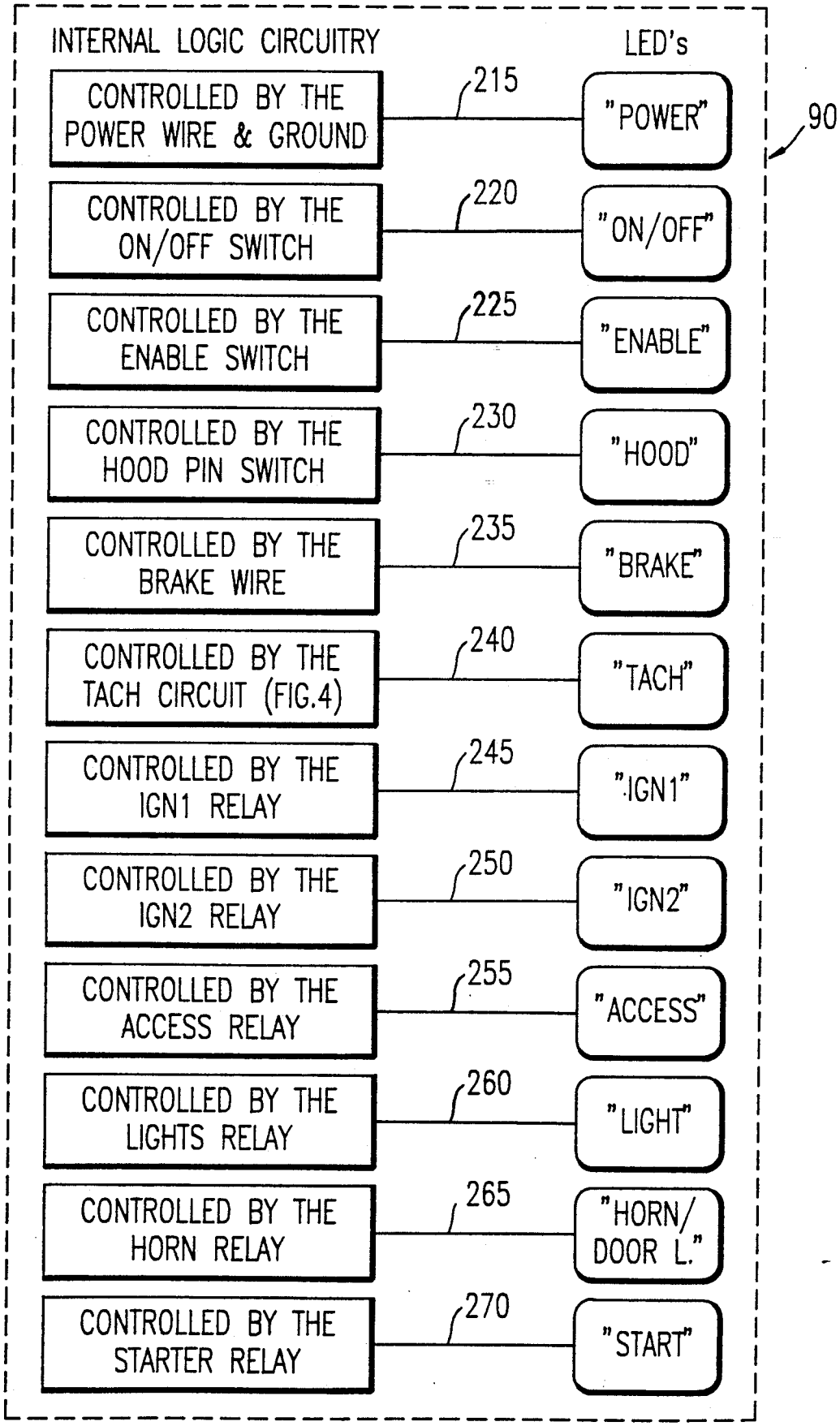
FIG. 2 shows the diagnostic system in greater detail.

FIG. 2 details the diagnostic circuit 90 of FIG. 1. The diagnostic system 90 contains one LED for each of 11 vital wires to which the remote starter must be hooked additionally a wire is provided for +12 volts and ground. The +12 volt and ground wire lights up the LED 10 to show power to the unit. The other LEDs are clearly labeled as follows: on/off 220, enable 225, hood 230, brake 235, tach 240, ignition one 245, ignition two 250, access 255, light 260, horn 265, and start 270. Each of these LEDs is controlled by the appropriate switch, wire or relay. These LEDs indicate if the unit is hooked up correctly. For example, to verify that the hook up is correct for the starter wire, the key is inserted and turned notch by notch from off, to accessory, to run, and then to start. At the start position, the start LED lights up if the start wire is hooked up properly. Another example is the accessories wherein the accessories LED will be on in the accessory position and run position, but off in the start position. This kind of feedback greatly decreases the troubleshooting time necessary to detect installation errors and subsequent unit failures.

One of the 12 LEDs has an additional unique feature. Instead of being just on or off, the "tach" LED gives a variable signal depending on the rpm rate of the car. This unique feature will be described in greater detail below with respect to FIG. 4.

Figure 3:
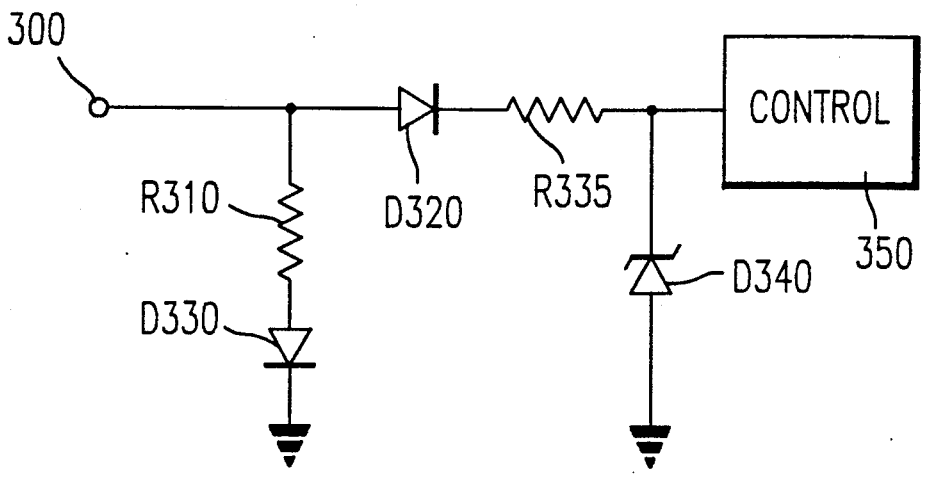
FIG. 3 details the brake circuit of the diagnostic system.

FIG. 3 details the brake circuit of FIG. 2. This circuit is representative of all the other sensor input circuits except for the tach circuit which is shown in detail in FIG. 4. FIG. 3 shows a brake input 300 connected to a limiting resistor R310 which is then connected to the brake LED 330 which is then connected to ground. Also connected to the brake input 300 is a diode D320 in series with a resistor R335. The output of resistor R335 is connected to ground through Zener diode D340 and is also connected to control circuit 350. This circuit will function to provide the installer with visual feedback when pressing the brake pedal. That is, if the wire is hooked up correctly, when the brake is depressed, the brake LED 330 will light up. D320, R335 and D340 function as an interface circuit to drop the voltage level on the brake line from the !2 volt level to 5 volts, which is safe to apply to the control circuit. The control circuit in this case may control other safety features, such as shutting off the car when the brake is depressed.

In an exemplary embodiment of FIG. 3, the values for R310 and R335 may be 1.5 k and 1.5 M , respectively.

Figure 4:
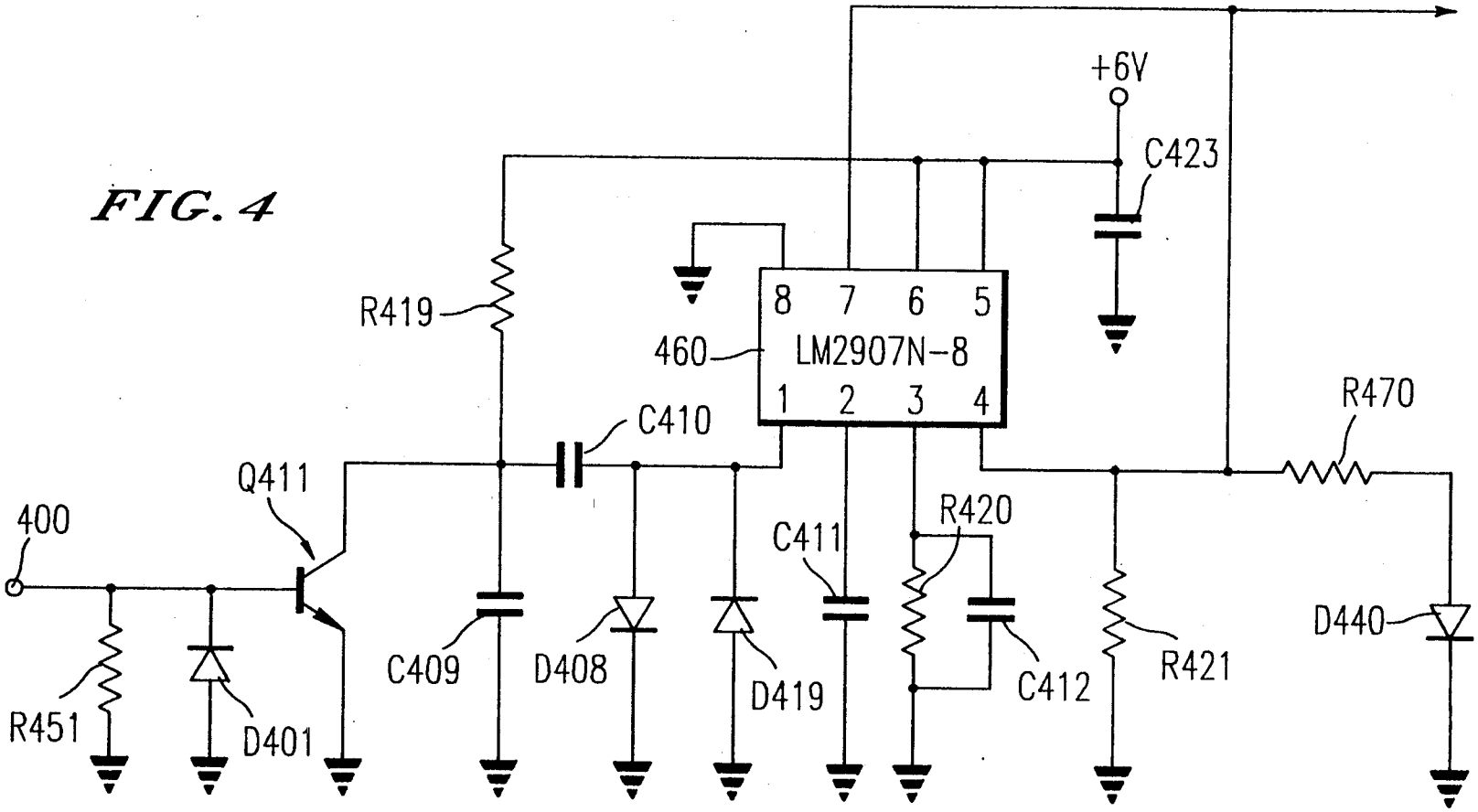
FIG. 4 details the tach circuit of the diagnostic system.

FIG. 4 details the unique "tach" LED circuit of the present invention. This circuit is designed so that the LED is off at 1000 rpms, glows dimly at 2000 rpms and is at full brightness at 3000 rpms. Thus, when the car is running, the installer can push the gas pedal down and quickly verify that the remote automobile starter unit is reading the correct rpm rate.

The tach input for a remote automobile starter unit may be an inductive pick up arrangement that clamps around any one of the spark plug wires coming from the distributor. This inductive pick up will have a coil of wire with one side going to ground and the other side going to the remote automobile starter unit at the tach input point. This inductive pick up outputs a high voltage pulse every time a spark plug fires.

In FIG. 4, we see a tach input 400 connected to resistor R418 which is then connected to the base of transistor Q411. A resistor R451 and diode D401 are also each connected to the base of Q411 and ar then each connected to ground. The collector of Q411 is connected to pin 1 of the LM2907N-8 frequency to voltage converter, manufactured by National, through capacitor C410. Also connected to pin 1 of the LM2907N-8 is a diode D408 and a diode D419 which are also each connected to ground. A capacitor C409 is connected between the collector of Q411 and ground. Connected between pin 2 of the LM2907N-8 and ground is capacitor C411. Connected between pin 3 and ground is resistor R420 in parallel with capacitor C412. Tach LED D440 in series with resistor R470 is connected between pin 4 and ground as is resistor R421. Connected to pins 5 and 6 is a voltage source generating +6 volts and a grounded capacitor C23. Also connected to pin 5 and 6 is a resistor R419 which is, in turn, connected to the collector of Q411. Pin 8 is grounded. The output of pin 7 is also connected to the output of pin 4.

The operation of the circuit of FIG. 4 will now be described. The tach input receives high voltage pulses every time a spark plug fires from the inductive pickup coil. The purpose of R418, R451, Q411, R419, C409, C410, D408 and D419 is to bring the voltage down to a level that is compatible with the LM2907N-8 integrated circuit. The LM2907N-8 is a frequency to voltage converter. As a frequency of the spark plug firings increases, the voltage level at the output, i.e. pins 4 and 7, rises. This output voltage signal passes through limiting resistor R470, through tach LED 420 to ground. The tach LED will provide a visual indication as follows: off at 1000 rpms (idling); glowing dimly at 2000 rpms; and gradually attaining full brightness as the rpms are brought to 3000. By pushing down on the gas pedal of the car during the installation stage, the installer can verify that the tach circuit is reading the correct rpm rate. Correctly reading the tach rate may be important for another reason. That is, a remote automobile starter unit may be designed to apply power to the starter wire until the rpms rise above 500 in order to control starting. Therefore, if the inductive pick up were installed incorrectly, the unit would not funtion properly. In that case, the output voltage from pins 4 and 7 of the LM2907N-8 would be compared to a reference voltage by a comparator. When the output voltage reachs a level which is proportional to an rpm rate of greater than 500, then the comparator outputs a signal which disengages the "starter" relay. Thus the output of the comparator, controls the duration of engagement of the starter, i.e. how long it "cranks the car".

In an exemplary embodiment of FIG. 4, the values for the various components are: R418, R451, R419, R420, R421, and R470 are, 1.5 kΩ, 1 MΩ, 100 MΩ, 10

MΩ, and 470 Ω, respectively. The values for C409, C410, C411, C412, and C423, are, 0.1 μf, 0.01 μf, 0.22 μf, and 4.7 μf, and 0.1 μf, respectively.

Figure 5:
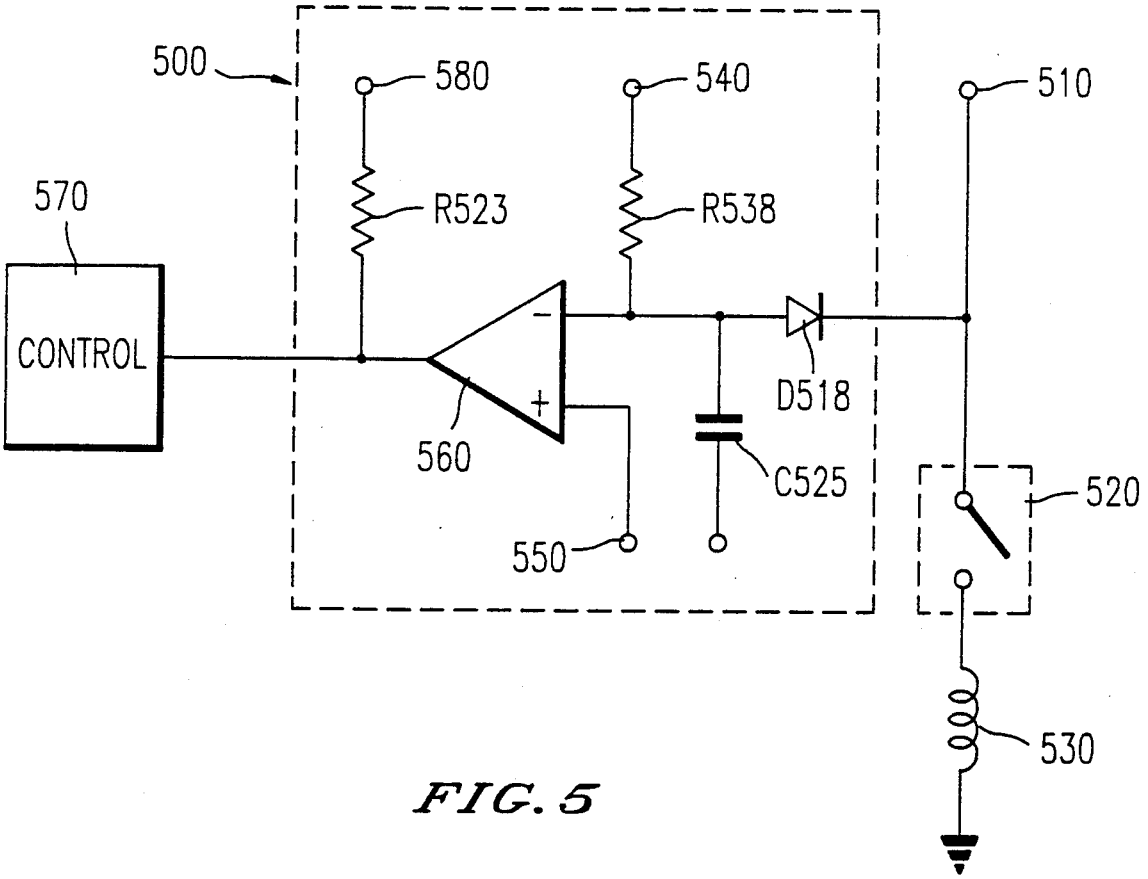
FIG. 5 details the neutral switch sensing circuit.

FIG. 5 details the novel neutral switch sensing feature of the present invention. This feature will turn off the remote automobile starter unit if the car is put into gear, thereby turning off the automobile unless the user's key has been put in the ignition and turned to the "run" position. This feature functions by taking advantage of the fact that all starter solenoids have a "motor winding". One side of this "motor winding" has an input from the starter wire behind the key, and the other side goes to ground. The "motor winding" itself has a low electrical resistance impedance ( usually between 2 Ω and 100 Ω). When power starter wire through the "motor winding" to ground, it energizes the starter solenoid which activates the starter motor to "turn the car over".

Because all starter wires have a path to ground through the starter solenoid motor winding, and since the neutral safety switch physically disconnects this path when the car is in gear, the neutral switch sensing feature of the present invention operates to "look" down the starter wire through the neutral starter switch to the starter solenoid motor winding to ground. The present invention allows a few millamperes of current to always trickle down this starter wire to ground. As long as the circuit of the present invention senses this current flow down the starter wire, it is known that the car is in "park". When the car is in any gear, the "neutral safety switch" opens and causes this low impedance to ground to immediately jump to a very high impedance (actually an "open circuit"). Should the circuit of the present invention see this high impedance condition, it will automatically shut down the remote automobile starter. If the key has not been inserted in the ignition and put in the "run" position, i.e. if the key actuator is still in the "off" position, shutting down of the remote automobile starter at this point will cause the automobile itself to shut down. If the key has been turned to the "run" position, shutting down of the remote automobile starter at this point will not affect operation of the vehicle and it will continue to run. Thus, the neutral switch sensing circuit of FIG. 5 will automatically shut off the automobile if the car is put into any gear and the key has not been turned to the "run" position.

Turning now to FIG. 5 which details the neutral switch sensing circuit of the present invention. Outlined box 500 represents the neutral switch sensing circuit of the present invention. Node 510 represents the input from the starter wire which goes through neutral safety switch 520 and starter solenoid motor winding 530 to ground. Diode D518 is connected between the negative input of comparator 560 and the starter wire input node 510. Also connected to the negative input of comparator 560 is a voltage source 540, through resistor R538, and a capacitor C525 which is connected between the negative input and ground. The positive input of the comparator 560 is a reference voltage 550. Connected to the output of comparator 56 is control circuit 570 and a voltage source 580, through resistor R523.

In an exemplary embodiment of FIG. 5, the values for the various circuit components is as follows: R538 and R523 are 1.5 KΩ each; C525 is 0.1 μf; voltage source 540 and reference voltage 550 are 5 v. and 2.5 v, respectively.

The theory of operation for the neutral switch sensing circuit of FIG. 5 will now be described. When the car is in park, neutral safety switch 520 will be closed. Voltage source 540 will cause a very small current to pass through R538 and D518, through the neutral safety switch 520, and to the starter solenoid motor winding 530 to ground. R538 and starter solenoid motor winding 520 function as a voltage divider to thereby induce a voltage at the negative input of the comparator 560 which is less than the voltage output by voltage source 540. Thus, voltage source 540, resistor R538, and reference voltage source 550, are chosen so that, in this state, the voltage at the negative input of the comparator 560 is less than the voltage at the positive input, i.e. less than the reference voltage 550. When the car is taken out of park, neutral safety switch 520 opens. The voltage at the negative input of comparator 560 is then undivided and is thus greater than the reference voltage 550. The output of comparator 560 therefore changes states and causes the control circuit 570 to disable the remote automobile starter.

Figure 6:
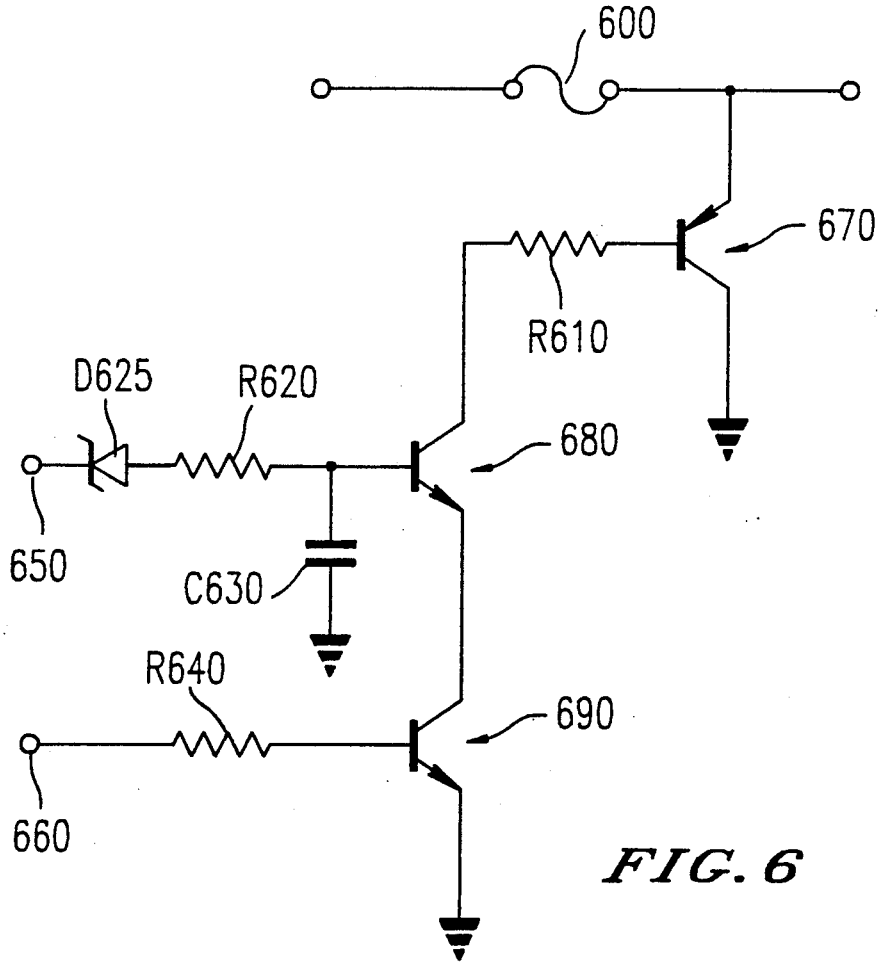
FIG. 6 details the self-disablement circuit.

FIG. 6 represents the manual transmission car self-disablement circuit of the present invention. This circuit functions to disable the remote automobile starter if it has been hooked up to a car with a manual transmission. This circuit functions by beginning to "look" at the wiring of the car from the time it is installed in the car. When it discovers that the car has a manual transmission, it will intentionally self-disable one particular component on the main control of the remote automobile starter rendering the entire unit inoperable. The entire unit then will have to be sent back to the factory for repair.

The self-disablement circuit of the present invention takes advantage of the same characteristics that the neutral switch sensor does. On all automatic transmission cars the starter wire can "see" the starter motor when in park (and in some cars in neutral) because of a low impedance, but cannot "see" the starter motor when in any gear (because of a high impedance, actually an "open circuit"). Furthermore, manual transmission cars do not feature a "neutral safety switch". Thus, in manual transmission cars the starter wire can always "see" the starter motor. Once the self-disablement circuit is installed in a car, it begins to "look" for a situation where the rpm rate of the car (the tach rate) is above 2200 signifying either a speed in excess of 50 mph or that the person is revving up the car while parked (a car idles at about 1000 rpm). Once this condition is reached, the self-disablement circuit continues to "look" down the starter wire to the starter motor. If the self disablement circuit never "sees" the car go out of park, and the condition of greater than 2200 rpm's continues for several minutes (e.g. 5), then the car is determined to have a manual transmission. This situation will happen whenever a person driving a manual transmission car is driving at over 50 mph for more than 5 consecutive minutes. At this point, on a manual transmission car, the self-disablement circuit will self-disable one component of the remote starter rendering the entire unit inoperable for future remote applications. Through normal operation of the vehicle, the unit should be disabled in a short period of time.

FIG. 6 details the self-disablement circuit of the present invention. In FIG. 6, a fuse 600 is placed in series in any appropriate critical circuit in the remote automobile starter. Fuse 600 is connected to the emitter of transistor 670 with the collector of 670 being connected to ground and the base being connected, through resistor R610, to the collector of transistor 680. The base of transistor 680 is connected to ground through a capacitor C630. Input signal 650 is also connected, through zener diode 670 and resistor R620, to the base of transistor 680. The emitter of transistor 680 is connected to the collecter of transistor 690. Input signal 660, through resistor R640, is connected to the base of transistor 690. The emitter of transistor 690 is grounded.

The theory of operation for the self-disablement circuit of FIG. 6 will now be described. Fuse 600 is placed in series in any critical circuit of the remote starter. Input 650 is a voltage signal which is proportional to the rpm rate of the engine. For example, the output from the frequency to voltage converter of FIG. 4 supplies the input signal 650. When the rpms of the automobile engine reach a certain rate for a predetermined period of time, transistor Q1 is turned on. That is, resistor R620 and capacitor C630 function to delay the turning on of transistor Q1 for the predetermined period of time. R620 and C630 are, for example, 10,000 Ω and 1,000 μf, respectively. In this case, Q1 will be turned on when input voltage 650 is approximately 3.6 volts, which will correspond to approximately 2200 rpm, for about 5 minutes. Input signal 660 is an input from a neutral sensor circuit (not shown) which is high when an automatic transmission car is in park, i.e. when the "neutral safety switch" is closed, or when a manual transmission car is in any gear. When input 660 goes high, transistor Q2 is turned on. When both transistors Q1 and Q2 are turned on, transistor Q3 is also turned on which then causes fuse 600 to blow. This renders inoperable the circuit of fuse 600, and the remote starter unit no longer functions.

Obviously, numerous additional modifications and variations of the present invention are possible in light of the above teachings. It is therefore to be understood that within the scope of the apended claims, the invention may be practiced otherwise than as specifically described herein. For example, although the present invention is accomplished with discrete components (i.e., resistors, capacitors, transistors and a few integrated circuits), some circuitry could easily be replaced with a fewer number of parts by using a micro-controller such as the Motorola 6800 series. Also, it would be apparent to those skilled in the art that the features of the present invention disclosed could be incorporated in other types of products.

What is claimed as new and desired to be secured by Letters Patent of the U.S. is:

1. An automobile installation diagnostic test system comprising:

an add-on remote automobile starter said remote starter being connected to a starter motor of said automobile, and to to a plurality of pre-existing automobile electrical sensing circuits which electrically sense respective predetermined conditions of said automobile;

an indicating means for receiving a signal from each of said pre-existing automobile and electrical sensing circuits for indicating that each of said predetermined conditions is being sensed, thereby ensuring that said remote starter is installed correctly.

2. The apparatus of claim 1, wherein said indicating means is a light-emitting diode.

3. The apparatus of claim 1, wherein one of said received signals is comprised of input pulses which are generated with each revolution of an automobile engine, and further comprising:

frequency to voltage conversion means connected to receive said received signal and outputting a voltage signal which is proportional to the revolutions per minute of the automobile engine, wherein said output signal is supplied to said indicating means.

4. The apparatus of claim 3, wherein said indicating means comprises a variable light-emitting diode, wherein said variable light-emitting diode does not begin glowing until the revolutions per minute of automobile engine exceed 1,000.

5. An apparatus for preventing a remotely started automobile from being driven unless an operator has turned the key actuator to the "RUN" position, comprising:

means for generating a voltage signal which causes a current to pass through a starter solenoid;

means for voltage dividing said voltage signal;

means for generating a reference voltage, wherein said reference voltage is greater than said voltage divided voltage when said automobile is in park and said reference voltage is less than said voltage divided voltage when said automobile is taken out of park;

means connected to receiving said voltage divided voltage signal and said reference voltage for comparing the reference voltage to said voltage divided voltage signal;

means, connected to receive the output of said comparing means, for disabling said remote starter when said automobile is taken out of park and said reference voltage is less than said voltage divided voltage signal.

6. An apparatus for disabling a remote automobile starter which is connected to an automobile with a manual transmission, comprising:

an automobile;

a remote starter connected to said automobile;

means for detecting a first condition that the engine of said automobile is operating at greater than a predetermined number of revolutions per minute for a predetermined period of time;

means for detecting a second condition that transmission of said automobile has not been taken out of park by an opening of a neutral safety switch;

means for disabling the remote automobile starter when both the first and second conditions are detected.

7. The apparatus of claim 6, wherein said disabling means comprising a fuse which blows when said first and second conditions are detected.

8. An improved remote automobile starter system connected to an automobile, wherein said remote automobile starter is connected to an automobile starter motor and to a plurality of preexisting automobile electrical circuits which electrically sense predetermined conditions of said automobile, comprising;

an indicating means for receiving a signal from each of said preexisting automobile electrical sensing circuits for indicating that each of said predetermined conditions is being sensed;

means for generating a voltage signal which causes a current to pass through a starter solenoid;

means for voltage dividing said voltage signal;

means for generating a reference voltage, wherein said reference voltage is greater than said voltage divided voltage when said automobile is in park and said reference voltage is less than said voltage divided voltage when said automobile is taken out of park;

means, connected to receive said voltage divided voltage signal and said reference voltage, for comparing said reference voltage to said voltage divided voltage signal;

means, connected to receive the output of said comparison means, for disabling said remote starter when said automobile is taken out of park and said reference voltage is less than said voltage divided voltage signal;

means for detecting a first condition that the engine of said automobile is operating at greater than a predetermined number of revolutions per minute for a predetermined period of time;

means for detecting a second condition that the transmission of said automobile has not been taken out of park by opening of a neutral safety switch;

means for disabling said remote automobile starter when both the first and second conditions are detected.

9. The apparatus for claim 8 wherein said indicating means is a light emitting diode.

10. The apparatus of claim 8, wherein one of said received signal is comprised of input pulses which are generated with each revolution of an automobile engine, and further comprising:

frequency to voltage conversion means connected to receive said received signal and outputting a voltage signal which is proportional to the revolutions per minute of the automobile engine, wherein said output signal is supplied to said indicating means.

11. The apparatus of claim 10, wherein said indicating means comprises a variable light-emitting diode, wherein said variable light-emitting diode does not begin glowing until the revolutions per minute of the automobile engine exceed 1,000.

12. The apparatus of claim 8 wherein said disabling means comprises a fuse which blows when said first and second conditions are detected.

* * * * *